United States Patent [19]

Fohl et al.

[11] Patent Number: 5,003,220

[45] Date of Patent: Mar. 26, 1991

[54] INTEGRAL LAMP FOR TRI-COLOR PICTURE ELEMENT

[75] Inventors: Timothy Fohl, Carlisle; Warren C. Gungle, Danvers; Robert Y. Pai, Hamilton, all of Mass.

[73] Assignee: GTE Products Corporation, Danvers, Mass.

[21] Appl. No.: 64,731

[22] Filed: Jun. 22, 1987

[51] Int. Cl.[5] ..... H01J 61/30; H01J 61/42

[52] U.S. Cl. ..... 313/488; 313/493; 313/635

[58] Field of Search ..... 313/488, 493, 634, 635

[56] References Cited

U.S. PATENT DOCUMENTS

| | | | |
|---|---|---|---|
| 3,115,309 | 12/1963 | Spencer et al. | 313/488 |
| 3,225,241 | 12/1965 | Spencer et al. | 313/488 |
| 3,365,323 | 1/1968 | Repsher | 313/489 |
| 3,379,917 | 4/1968 | Menelly | 313/488 |
| 3,987,331 | 10/1976 | Schreurs | 313/486 |
| 4,088,802 | 5/1978 | Shriver, Jr. | 427/67 |
| 4,374,340 | 2/1983 | Bouwkneet et al. | 313/493 |
| 4,426,602 | 1/1984 | Mollet et al. | 315/58 |
| 4,481,442 | 11/1984 | Albrecht et al. | 313/493 |
| 4,559,480 | 12/1985 | Nobs | 315/324 |
| 4,625,152 | 11/1986 | Nakai | 315/317 |

FOREIGN PATENT DOCUMENTS

| | | | |
|---|---|---|---|
| 91546 | 5/1985 | Japan | 313/488 |
| 2145873A | 4/1985 | United Kingdom . | |
| 2167895A | 6/1986 | United Kingdom | 313/610 |

*Primary Examiner*—Kenneth Wieder
*Attorney, Agent, or Firm*—Carlo S. Bessone

[57] ABSTRACT

A tri-color lamp for use as an element in the optical presentation of information. The lamp includes a sealed envelope having a common envelope member and a plurality (e.g., three) of longitudinally extending leg members. A common electrode is located within the common envelope member and is spacedly located from opposing electrodes located within each of the leg members. A phosphor layer within the sealed envelope subtends at least the major body portion of each of the leg members such that the surface brightness of the phosphor layer as viewed through the end portions of the lamp is greater than the intensity of the external surface brightness of the phosphor layer on the major body portion. In the presentation of color information, each of the leg members is coated with respective phosphors emitting the primary colors red, green and blue.

9 Claims, 4 Drawing Sheets

INTEGRAL LAMP FOR TRI-COLOR PICTURE ELEMENT

CROSS REFERENCE TO OTHER APPLICATIONS

This application discloses, but does not claim, inventions which are claimed in U.S. Ser. Nos. 064,978 and 064,961 filed concurrently herewith and assigned to the Assignee of this application Ser. No. 064,961 is now U.S. Pat. No. 4,786,841.

TECHNICAL FIELD

This invention relates to low-pressure arc discharge lamps and more particularly to such lamps adaptable for use both as an element in a picture display and in certain general illuminating applications wherein a considerable portion of the light emitted from the lamp is directed in a particular direction.

BACKGROUND OF THE INVENTION

Low-pressure arc discharge lamps have been used for optical presentation of information, i.e., presentation of alpha numeric signs, graphics and pictures displayed on a screen or display, respectively. Such a display consists of a matrix of picture elements, each picture element consisting of a monochrome light signal source in the case of a monochrome display. In the case of a color presentation of information, one picture element is composed on three single lamps of the primary colors red, green and blue. The desired color impression is then created physiologically by additive mixture of the three primary colors within the human eye/brain system.

There have been proposed a wide variety of fluorescent lamps of such special configuration as to be applicable to such displays. For example, FIG. 1 of UK Patent Application No. GB 2 145 873 A, published on Apr. 3, 1985, shows one typical lamp which comprises a phosphor-coated tubular envelope of convoluted tridimensional configuration that contains a pair of electrodes and an ionizable medium. For construction of the color display, a multiplicity of the above fluorescent lamps are arranged in a matrix (FIG. 2 of GB No. 2 145 873 A) so as to form one picture element by the combination of three lamps having the envelope coated with respective phosphors emitting the different primary colors, i.e., red, green and blue. The above-mentioned UK Application also shows a fluorescent lamp comprising a gas-filled envelope enclosing a plurality of discharge paths defined by U-shaped phosphor-coated tubes. In UK Patent Application No. GB 2 167 895 A, published on June 4, 1986, a fluorescent lamp assembly is shown in FIG. 18 comprising a central lamp base 201 with a cell 205 having a common electrode 208 therein and U-shaped lamp tubes 209*a*, 209*b* and 209*c* joined to communicate their interior with cell 205. Although the known lamps operate satisfactorily when used in some of such displays, drawbacks still exist.

Presenting information to a large audience in the open air means looking for a correspondingly large area display which is distinctly visible not only at night but also during daylight and with sufficient optical resolution from a greater viewing distance. In the above known lamps, only the curved portion of the U-shaped envelope is presented towards the audience so that no more than approximately 20 percent of the radiation is effective. The rest is dissipating, especially through the parallel legs of the U-shaped envelope which are arranged parallel to the longitudinal axis of the lamp and substantially normal or perpendicular, respectively, to the plane of fixation of a unit, said plane being also substantially normal to the viewing direction of the spectators. The surface brightness along the envelope is substantially constant, i.e., one area along the envelope does not appear brighter than another area.

Other low-pressure arc discharge fluorescent lamps primarily used for general illumination are known in which the envelope includes at least two longitudinally extending leg members joined together by a transversely extending envelope portion. Examples of such lamps which are commercially available are the "Twin Tube" and "Double Twin Tube" fluorescent lamps manufactured by GTE Sylvania, Danvers, Mass. Other examples are disclosed in U.S. Pat. No. 4,374,340, which issued to Bouwknegt et al on Feb. 15, 1983; U.S. Pat. No. 4,426,602, which issued to Mollet et al on Jan. 17, 1984; and U.S. Pat. No. 4,481,442, which issued to Albrecht et al on Nov. 6, 1984. Lamps described in the above-mentioned U.S. patents allow most of the radiation to be dissipated through the longitudinally extending leg members. The surface brightness along the envelope is also substantially constant.

BRIEF SUMMARY OF THE INVENTION

It is, therefore, an object of this invention to obviate the disadvantages of the prior art.

It is still another object of the invention to provide an improved arc discharge lamp adaptable for use both as a picture element in a picture display and in certain general illuminating applications wherein the surface brightness of the phosphor viewed through a portion of the lamp envelope substantially transverse to the longitudinal axis is of a greater intensity than the surface brightness of the phosphor on a longitudinally extending portion of the envelope.

These objects are accomplished in one aspect of the invention by the provision of an arc discharge lamp having a longitudinal axis comprising a sealed envelope having a longitudinal configuration and including a common envelope member and a plurality of longitudinally extending leg members joining the common envelope member, each of the longitudinally extending leg members having a major body portion and a minor transverse end portion. A common electrode is located within the common envelope member. An opposing electrode is located within each of the longitudinally extending leg members spacedly located from the common electrode for selective generation of an arc discharge between the common electrode and at least one of the opposing electrodes. An ionizable medium is contained within the sealed envelope. A phosphor layer within the sealed envelope subtends at least the major body portion of each of the longitudinally extending leg members such that the surface brightness of the phosphor layer as viewed through each of the the minor transverse end portions of the envelope is of greater intensity than the external surface brightness of the phosphor layer subtending the major body portion of a respective longitudinally extending leg member during selective operation of the lamp.

In accordance with further teachings of the present invention, the sealed envelope includes at least first, second and third longitudinally extending leg members each joining the common envelope portion through a respective transversely extending envelope portion. In a preferred embodiment, the phosphor layer subtending the major body portion of the first, second and third longitudinally extending leg members is of different spectral power distribution.

In accordance with further teachings of the present invention, the first, second and third longitudinally extending leg members each have a minor transverse end portion associated therewith. At least a part of each of the minor transverse end portions does not have a phosphor layer disposed on the internal surface thereof.

In accordance with further aspects of the present invention, a reflector layer is disposed on the internal surface of the major body portion of the first, second and third longitudinally extending leg members and not disposed on the internal surface of at least a part of each of the minor transverse end portions. A phosphor layer is disposed on the reflector layer. In one embodiment, the phosphor layer is also disposed on the internal surface of a part of each of the minor transverse end portions.

In accordance with still further aspects of the present invention, the first, second and third longitudinally extending leg members are triangularly disposed around the common envelope portion centrally disposed therebetween.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
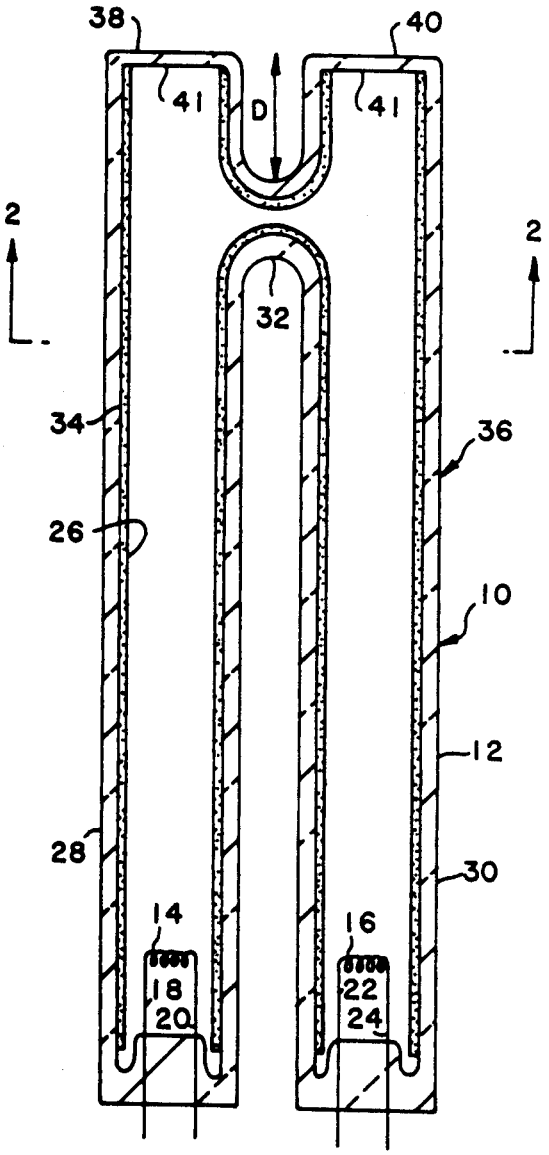
FIG. 1 is a front elevational cross-sectional view of an embodiment of an arc discharge lamp according to the invention.
Figure 2:
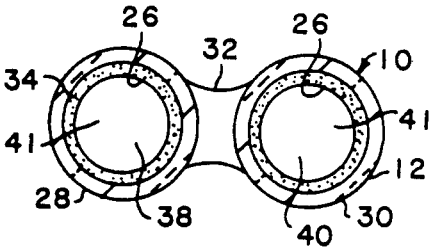
FIG. 2 is a cross-sectional view of the arc discharge lamp taken along the line 2—2 in FIG. 1.

Referring now to the drawings with greater particularity to FIGS. 1 and 2, there is illustrated an arc discharge lamp 10, such as a fluorescent lamp, including a sealed envelope 12 containing an ionizable medium including a quantity of mercury and an inert starting gas at low pressure, for example, in the order of 1–5 mm of mercury. The starting gas can be, for example, argon, krypton, neon, or helium, or a mixture of these and other gases. A pair of electrodes 14, 16 supported by lead-in wires 18, 20 and 22, 24, respectively, is spacedly located within envelope 12 for generating an arc discharge therebetween during operation of lamp 10. Electrodes 14, 16 can be, for example, a double or triple-coiled tungsten filament of the usual type and carry a coating thereon which is usually in the form of carbonates which upon processing, are converted to oxide. Alternatively, one of the pair of electrodes may be in the form of an anode suitable for D.C. operation and requires only support from a single lead-in wire. A phosphor layer within sealed envelope 12 converts the ultraviolet radiation generated in the mercury discharge into visible radiation.

Envelope 12 of arc discharge lamp 10 in FIGS. 1 and 2 includes first and second longitudinally extending leg members 28 and 30, respectively. Also included with envelope 12 is a transversely extending envelope portion 32 joining the first and second longitudinally extending leg member 28 and 30 to form a continuous passage therethrough for the arc discharge. Transversely extending envelope portion 32 is longitudinally spaced a predetermined distance D (e.g., 0.375 inch) from an end portion of envelope 12. The transversely extending envelope portion may have various other shapes, for example, a squared U-shape configuration as illustrated by 42 in the partial front elevational view of the arc discharge lamp 10A of FIG. 3 or a rounded U-shape configuration as illustrated by 43 in the partial front elevational view of the arc discharge lamp 10B of FIG. 4.

In the embodiment shown in FIGS. 1 and 2, envelope 12 includes a major body portion 36 and first and second minor transverse end portions 38 and 40, respectively associated with first and second longitudinally extending leg members 28 and 30. A phosphor layer 26 is disposed on the internal surface 34 of major body portion 36 of envelope 12. Preferably, as illustrated in FIGS. 1 and 2, substantially the entire internal circumference of leg members 28 and 30 is coated with phosphor layer 26. According to the teachings of the present invention, the phosphor layer is not disposed on the internal surface of at least a part of at least one of the minor transverse end portions. As best illustrated in FIGS. 1 and 2, flat surface 41 on minor transverse end portions 38 and 40, which lies in a plane substantially perpendicular to the longitudinal axis of lamp 12, is devoid of phosphor. The minor transverse end portions may have a more curvilinear shape (See FIG. 4). The internal surface brightness of the phosphor layer as viewed through the part of the minor transverse end portion devoid of phosphor can be five or six times greater than the intensity of the external surface brightness of the phosphor layer over the major body portion of the envelope during operation of the lamp. An envelope with a T6 (0.75 inch) outside diameter will result in total area of increased surface brightness of approximately one square inch. The area of increased surface brightness can be varied by simply changing the diameter of the envelope.

Figure 3:
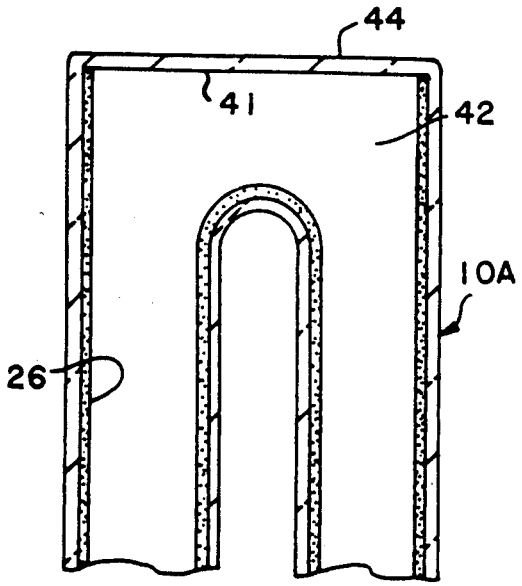
FIG. 3 is a partial front elevational view of an embodiment of an arc discharge lamp according to the invention showing the minor transverse end portion located on a flat surface of the transversely extending envelope portion.
Figure 4:
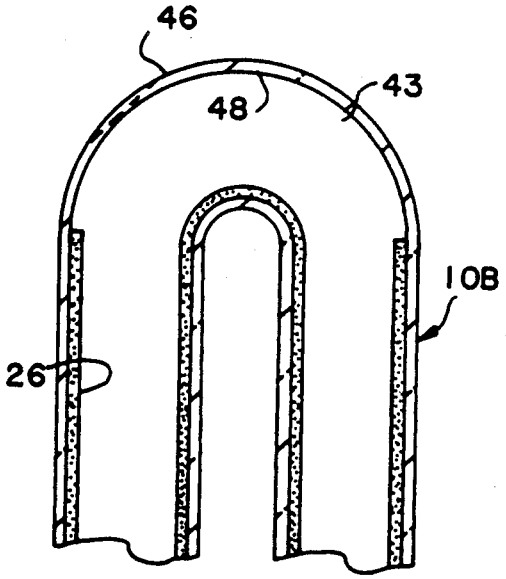
FIG. 4 is a partial front elevational view of another embodiment of an arc discharge lamp according to the invention showing the minor transverse end portion located on a U-shaped surface of the transversely extending envelope portion.

In the embodiment of FIGS. 3 and 4, the minor transverse end portion is located on the transversely extending envelope portion. In FIG. 3, minor transverse end portion 44 is located on the squared U-shaped transversely extending envelope portion 42. As illustrated, a flat surface 41 on end portion 44 is devoid of a phosphor layer. When viewed through the uncoated part of minor transverse end portion 44, the internal surface brightness of phosphor layer 26 is of greater intensity than the external surface brightness of phosphor layer 26 during lamp operation. In FIG. 4, minor transverse end portion 46 is located on the rounded U-shaped transversely extending envelope portion 43. As shown, a curvilinear U-shaped surface 48 on end portion 46 is devoid of a phosphor layer. Similarly during lamp operation, the internal surface brightness of phosphor layer 26 is of greater intensity than the external surface brightness of phosphor layer 26 when viewed through the uncoated part of minor transverse end portion 46.

Figure 5:
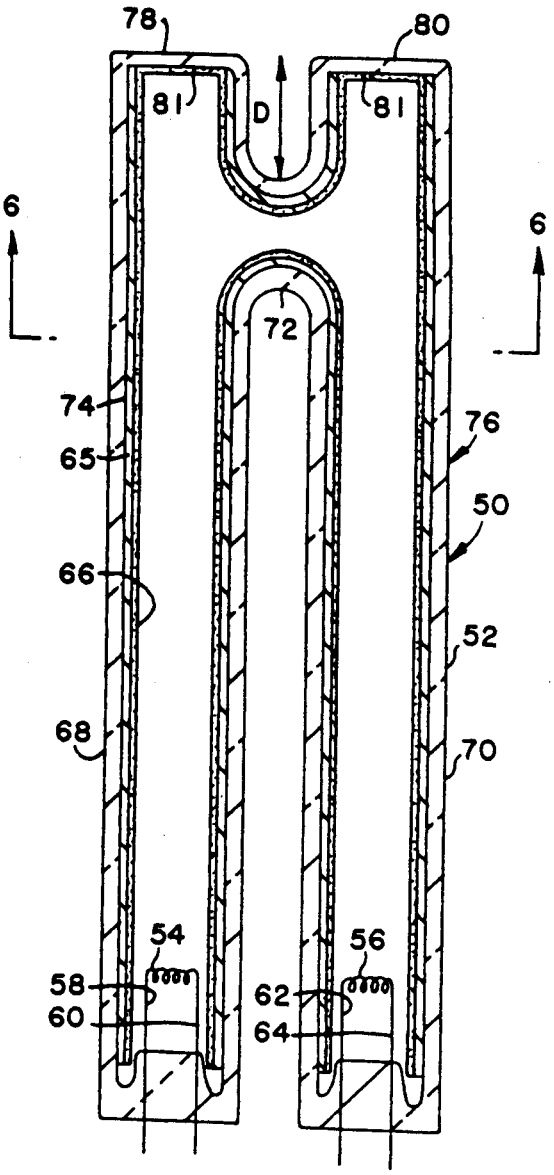
FIG. 5 is a front elevational cross-sectional view of another embodiment of an arc discharge lamp according to the invention.
Figure 6:
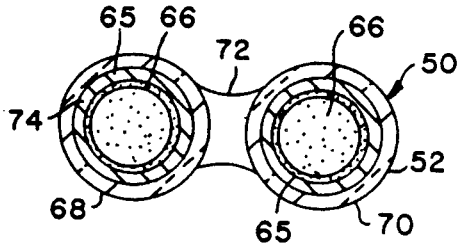
FIG. 6 is a cross-sectional view of the arc discharge lamp taken along the line 6—6 in FIG. 5.

Reference is now made to FIGS. 5 and 6 which show another embodiment of an arc discharge lamp according to the present invention. An arc discharge lamp 50, such as a fluorescent lamp, is shown including a sealed envelope 52 containing an ionizable medium including a quantity of mercury and an inert starting gas. A pair of electrodes 54, 56 supported by lead-in wires 58, 60 and 62, 64, respectively, is spacedly located within envelope 52 for generating an arc discharge therebetween during operation of lamp 50.

Envelope 52 includes first and second longitudinally extending leg members 68 and 70, respectively. Also included with envelope 52 is a transversely extending envelope portion 72 joining the first and second longitudinally extending leg members 68 and 70 to form a continuous passage therethrough for the arc discharge. Transversely extending envelope portion 72 is longitudinally spaced a predetermined distance D from an end portion of envelope 52. Envelope 52 includes a major body portion 76 and first and second minor transverse end portions 78 and 80, respectively associated with first and second longitudinally extending leg members 68 and 70.

To increase the surface brightness of lamp 50, a reflector layer 65 is disposed on the internal surface 74 of major body portion 76 of envelope 52. According to the teachings of the present invention, the reflector layer is not disposed on the internal surface of at least a part of at least one of the minor transverse end portions. In the embodiment illustrated in FIGS. 5 and 6, a part of each of the minor transverse end portions 78 and 80 is devoid of the internal reflector layer. Reflector layer 65 can be a non-absorbing material, such as, titanium dioxide or alumina. Thus the light which would normally be emitted out of the leg members would be reflected back into the lamp to further increase surface brightness.

A phosphor layer 66 is disposed on reflector layer 65 and, if desired, on a part of the internal surfaces of one or both of the minor transverse end portions. As shown in FIGS. 5 and 6, phosphor layer 66 is extended over the internal surfaces of both first and second minor transverse end portions 78 and 80. During lamp operation, the surface brightness of phosphor layer 66 as viewed through minor transverse end portions 78 and 80 of envelope 52 is of greater intensity than the external surface brightness of phosphor layer 66 on major body portion 76 of envelope 52. Preferably, as shown in FIGS. 5 and 6, substantially the entire internal circumference of leg members 68 and 70 is coated with reflector layer 65 overcoated with phosphor layer 66.

In the embodiments shown in FIGS. 1–6, at least minor transverse end portions 38, 40, 44, 46, 78, 80 are of light-transmitting vitreous material such as soda-lime or lead glass. Major body portions 36, 76 of first and second longitudinally extending leg members 28, 30 and 68, 70, respectively, can be made of a non-light-transmitting material, if desired.

Figure 7:
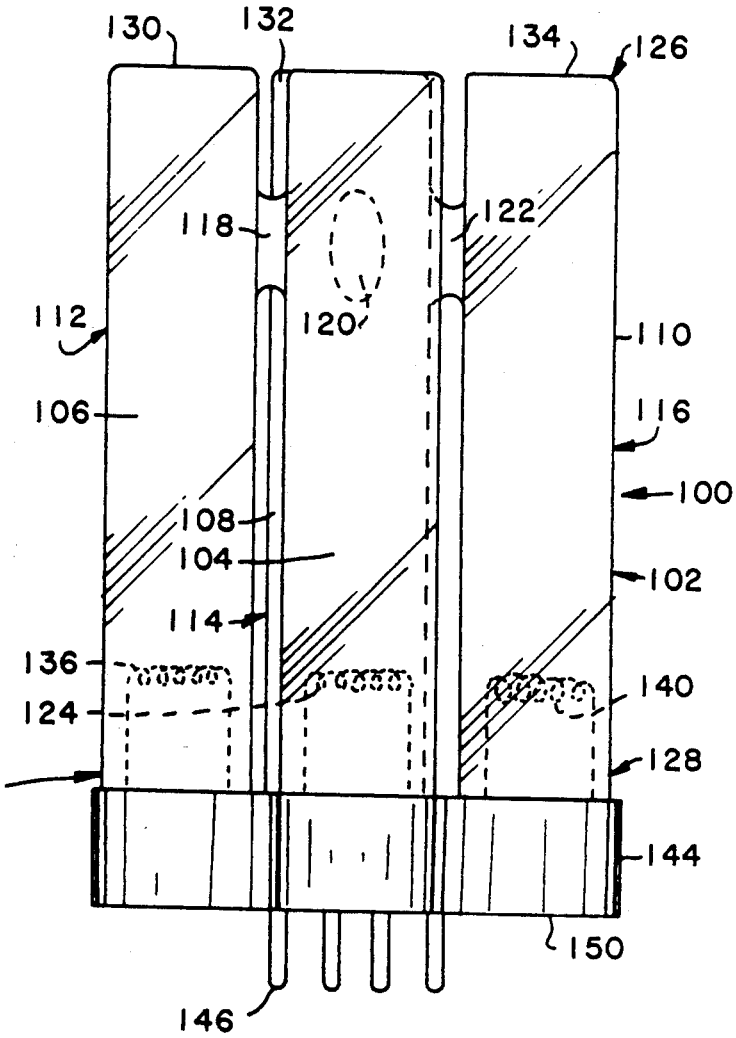
FIG. 7 is a front elevational view of an embodiment of an arc discharge lamp according to the invention.
Figure 8:
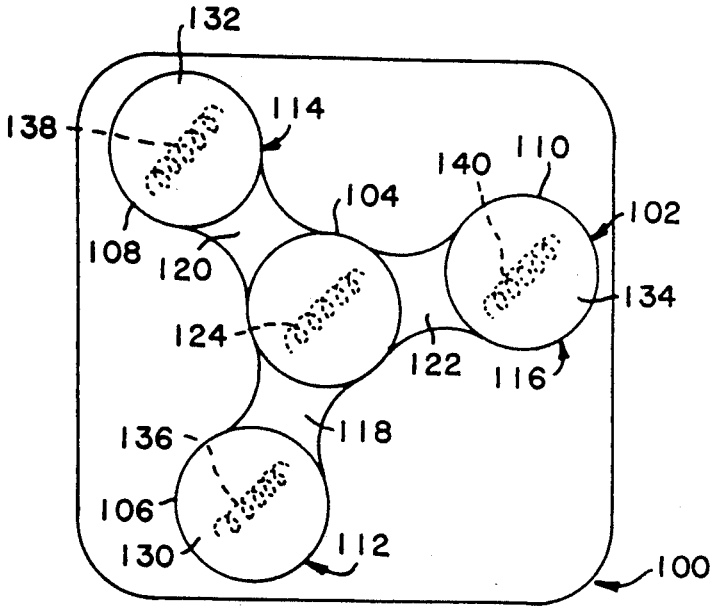
FIG. 8 is a plan view of the arc discharge lamp shown in FIG. 7.

The teachings of the above-described arc discharge lamps can be applied to form an arc discharge lamp which can be used in a color picture display. In FIGS. 7 and 8, an arc discharge lamp 100 is shown including a sealed envelope 102. Sealed envelope 102 includes a common envelope member 104 and a plurality of longitudinally extending leg members 106, 108, 110 joining common envelope member 104. Each of the longitudinally extending leg members 106, 108, 110 shown in FIGS. 7 and 8 are joined to common envelope member 104 through a transversely extending envelope portion 118, 120, 122, respectively. Leg members 106, 108, 110 each have a minor transverse end portion 130, 132, 134 respectively associated therewith located at a first end 126 of lamp 100. A compactly configured lamp can be obtained, for example, by triangularly disposing longitudinally extending leg members 106, 108, 110 around the common envelope member 104 which is centrally disposed therebetween.

A common electrode 124 is located within common envelope member 104 at a second end 128 (FIG. 7) of lamp 100. An opposing electrode 136, 138, 140 is located respectively within each of the longitudinally extending leg members 106, 108, 110 at second end 128 of lamp 100. Opposing electrodes 136, 138, 140 are spacedly located from common electrode 124. Accordingly an arc discharge can be selectively generated between common electrode 124 and one or more of the opposing electrodes 136, 138, 140. For example, by electrically selecting common electrode 124 and first opposing electrode 136, an arc discharge can be established from common electrode 124 (cathode) through common envelope member 104, first transversely extending envelope portion 118, first longitudinally extending leg member 106, to first opposing electrode 136 (anode). Simultaneously, an arc discharge can be established, for example, from common electrode 124 through common envelope member 104, second transversely extending envelope 120, second longitudinally extending leg member 108, to second opposing electrode 138. It is understood that electrodes 124, 136, 138, 140 may be configured or be made to operate as either an anode or cathode. Sealed envelope 102 contains an ionizable medium having a quantity of mercury and an inert starting gas at a low pressure, for example, in the order of 1–5 mm of mercury. Sealed envelope 102 can be made entirely of a light-transmitting vitreous material such as soda-lime or lead glass. Alternatively, minor transverse end portions 130, 132, 134 can be made of a light-transmitting material and the remainder of the envelope made of a non-light-transmitting material.

A phosphor layer within sealed envelope 102 subtends at least the major body portion 112, 114, 116 of each of the longitudinally extending leg members 106, 108, 110 by either being disposed on the internal surface thereof or on an underlying reflector layer. The surface brightness of the phosphor layer as viewed through each of the minor transverse end portions 130, 132, 134 is of greater intensity than the external surface brightness of the phosphor layer subtending the major body portion 112, 114, 116 of a respective longitudinally extending leg member 106, 108, 110 during selective operation of lamp 100. In the first embodiment, the phosphor layer does not subtend at least a part of the minor transverse end portions associated with the longitudinally extending leg members. In the second embodiment, the phosphor layer may also extend over the part of the internal surface of a minor transverse end portion not having the reflector layer thereon. For use in color picture display, the longitudinally extending leg members 106, 108, 110 can be provided with respective fluorescent phosphor layers of different spectral power distributions emitting the different primary colors, i.e., red, green and blue such as YOX($Y_2O_3$:Eu), CAT($MgAl_{11}O_{19}$:Ce,Tb) and BAM($BaMg_2Al_{16}O_{22}$:Eu), respectively. Turning the differently colored leg members on and off at a rate faster than the eye can react (e.g., faster than 30 times per second), a single pixel is seen by the unaided eye as a spot of light at normal viewing distances. The color and intensity thereof is determined by the length of time each color portion of the lamp is turned on. The color can be varied from pure red to pure green to pure blue along with color combinations thereinbetween. Preferably, the sealed envelope is configured and coated according to the present teachings to produce one pixel per lamp.

If the sealed envelope 102 is configured and coated according to the present teachings, three colored elements or dots per envelope will be produced. At normal viewing distances, the colored dots will appear to form a single pixel to the unaided eye. A filter coating or externally mounted filter can also be used to vary the color of the lamps.

Common envelope member 104, including the transverse top portion thereof, is left uncoated with phosphor or coated with a non-light emitting coating so as not to produce light.

Preferably, arc discharge lamp 100 includes a base member 144 supporting sealed envelope 102. Electrical contact means, such as pins 146, project from a surface 150 on base member 144 in order to provide connection from an electrical socket to the lamp electrodes.

While there have been shown and described what are at present considered to be the preferred embodiments of the invention, it will be apparent to those skilled in the art that various changes and modifications can be made herein without departing from the scope of the invention. For example, the lamps may have more than two leg members and more than one transversely extending envelope portion. Also, instead of an internal reflector layer or in addition thereto, an external non-absorbing reflector layer having a higher reflectivity than that of the internal reflector layer may be employed.

We claim:

1. An arc discharge lamp having a longitudinal axis comprising:

a sealed envelope having a longitudinal configuration and including a common longitudinally extending envelope member, a plurality of longitudinally extending leg members each having a major body portion and a minor transverse end portion respectively associated therewith, and transversely extending envelope portions located at one end of said lamp, each of said transversely extending envelope portions joining a respective leg member to said common envelope member;

a common electrode located within said common envelope member at the opposite end of said lamp;

an opposing electrode located within each of said longitudinally extending leg members spacedly located from said common electrode at said opposite end of said lamp for selective generation of an arc discharge between said common electrode and at least one of said opposing electrodes;

an ionizable medium contained within said sealed envelope; and a phosphor layer within said sealed envelope subtending at least said major body portions of each of said longitudinally extending leg members such that the surface brightness of said phosphor layer as viewed through each of said minor transverse end portions is of greater intensity than the external surface brightness of said phosphor layer subtending said major portion of a respective longitudinally extending member during selective operation of said lamp.

2. The arc discharge lamp of claim 1 wherein said sealed envelope includes at least first, second and third longitudinally extending leg members each joining said common envelope portion through a respective transversely extending envelope portion.

3. The arc discharge lamp of claim 2 wherein said first, second and third longitudinally extending leg members are triangularly disposed around said common envelope portion centrally disposed therebetween.

4. The arc discharge lamp of claim 2 wherein said phosphor layer subtending said major body portion has a different spectral power distribution for each of said first, second and third longitudinally extending leg members.

5. The arc discharge lamp of claim 2 wherein the said first, second and third longitudinally extending leg members each having a minor transverse end portion associated therewith, at least a part each of said minor transverse end portions not having a phosphor layer disposed on the internal surface thereof.

6. The arc discharge lamp of claim 2 wherein a reflector layer is disposed on the internal surface of said major body portion of said first, second and third longitudinally extending leg members and not disposed on the internal surface of at least a part of each of said minor transverse end portions, said phosphor layer being disposed on said reflector layer.

7. The arc discharge lamp of claim 6 wherein said phosphor layer is disposed on said reflector layer and the internal surface of said part of each of said minor transverse end portions.

8. The arc discharge lamp of claim 1 further including a base member supporting said lamp and having electrical contact means projecting from a surface of the base member.

9. An arc discharge lamp having a longitudinal axis comprising:

a sealed envelope having a longitudinal configuration and including a common longitudinally extending envelope member, a plurality of longitudinally extending leg members each having a major body portion and a minor transverse end portion respectively associated therewith, and transversely extending envelope portions located at one end of said lamp, each of said transversely extending envelope portions joining a respective leg member to said common envelope member;

a common electrode located within said common envelope member at the opposite end of said lamp;

an opposing electrode located within each of said longitudinally extending leg members spacedly located from said common electrode at said opposite end of said lamp for selective generation of an arc discharge between said common electrode and at least one of said opposing electrodes;

an ionizable medium contained within said sealed envelope; and a phosphor layer within said sealed envelope subtending at least said major body portions of each of said longitudinally extending leg members.

* * * * *